US006663445B1

(12) United States Patent
Yeh

(10) Patent No.: US 6,663,445 B1
(45) Date of Patent: Dec. 16, 2003

(54) ELECTRICAL CONNECTOR WITH STAGGERED CONTACTS

(75) Inventor: Joel Jyhhaur Yeh, Diamond Bar, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/211,436

(22) Filed: Aug. 2, 2002

(51) Int. Cl.[7] ..... H01R 4/48
(52) U.S. Cl. ..... 439/862; 439/66
(58) Field of Search ..... 439/862, 74, 66

(56) References Cited

U.S. PATENT DOCUMENTS 5,967,800 A 10/1999 Bishop

*Primary Examiner*—Javaid H. Nasri
(74) *Attorney, Agent, or Firm*—Wei Te Chung

(57) ABSTRACT

An electrical connector (100) for interconnecting a first and a second printed circuit boards (PCBs) includes an insulative base (1) and a first and a second sets of contacts (2, 3) received in the base. The insulative base defines a plurality of first and second channels (13, 14). The first and second channels respectively have first and second exposing portions (132, 141) arranged in two rows. The first and second sets of contacts respectively have first and second contact portions (21, 31) extending beyond an upper surface (11) of the base through the first and second exposing portions.

1 Claim, 5 Drawing Sheets

ELECTRICAL CONNECTOR WITH STAGGERED CONTACTS

BACKGROUND OF THE INVENTION

1. Field of the Invention

The present invention relates to electrical connectors and more particularly to electrical connectors used to interconnect electronic assemblies, for example, printed circuit boards (PCB).

2. Description of the Related Art

PCBs, which are required to be mounted one adjacent to another, but not necessarily, in a vertically arranged stack, need electrical connectors to electrically interconnect. As shown in FIGS. 6 and 7, U.S. Pat. No. 5,967,800 issued to Bishop on Oct. 19, 1999 discloses an electrical connector 200 for connecting a first and a second PCBs (not shown). The electrical connector 200 includes an insulative base 4 and a plurality of conductive contacts 5 received in the base 4. The insulative base 4 defines two rows of channels 41 along opposite sides thereof and exposed to an upper surface 42 of the base 4. Each conductive contact 5 is received in a corresponding channel 41, comprises a solder tail 52 for soldering on the first PCB and a contact portion 51 extending beyond the upper surface 42 of the base 4 for electrically engaging with the second PCB.

However, when many contacts 5 are required to engage with the PCBs, a corresponding number of channels 41 is also required to be distributed along opposite sides of the base 4. This makes the base 4 very long, relatively weak and easy to be broken.

Hence, an electrical connector with an improved contact arrangement is needed to overcome the foregoing shortcomings.

BRIEF SUMMARY OF THE INVENTION

A main object of the present invention is to provide an electrical connector with an improved contact arrangement.

An electrical connector for interconnecting a first and a second printed circuit boards (PCBs) in accordance with the present invention includes an insulative base and a first and a second sets of contacts received in the base. The insulative base defines a plurality of first and second channels. The first and second channels respectively have first and second exposing portions. The first exposing portions and the second exposing portions are arranged in two rows. The first and second sets of contacts respectively have first and second contact portions extending beyond an upper surface of the base through the first and second exposing portions.

Other objects, advantages and novel features of the invention will become more apparent from the following detailed description when taken in conjunction with the accompanying drawings.

DETAILED DESCRIPTION OF THE INVENTION

Figure 1:
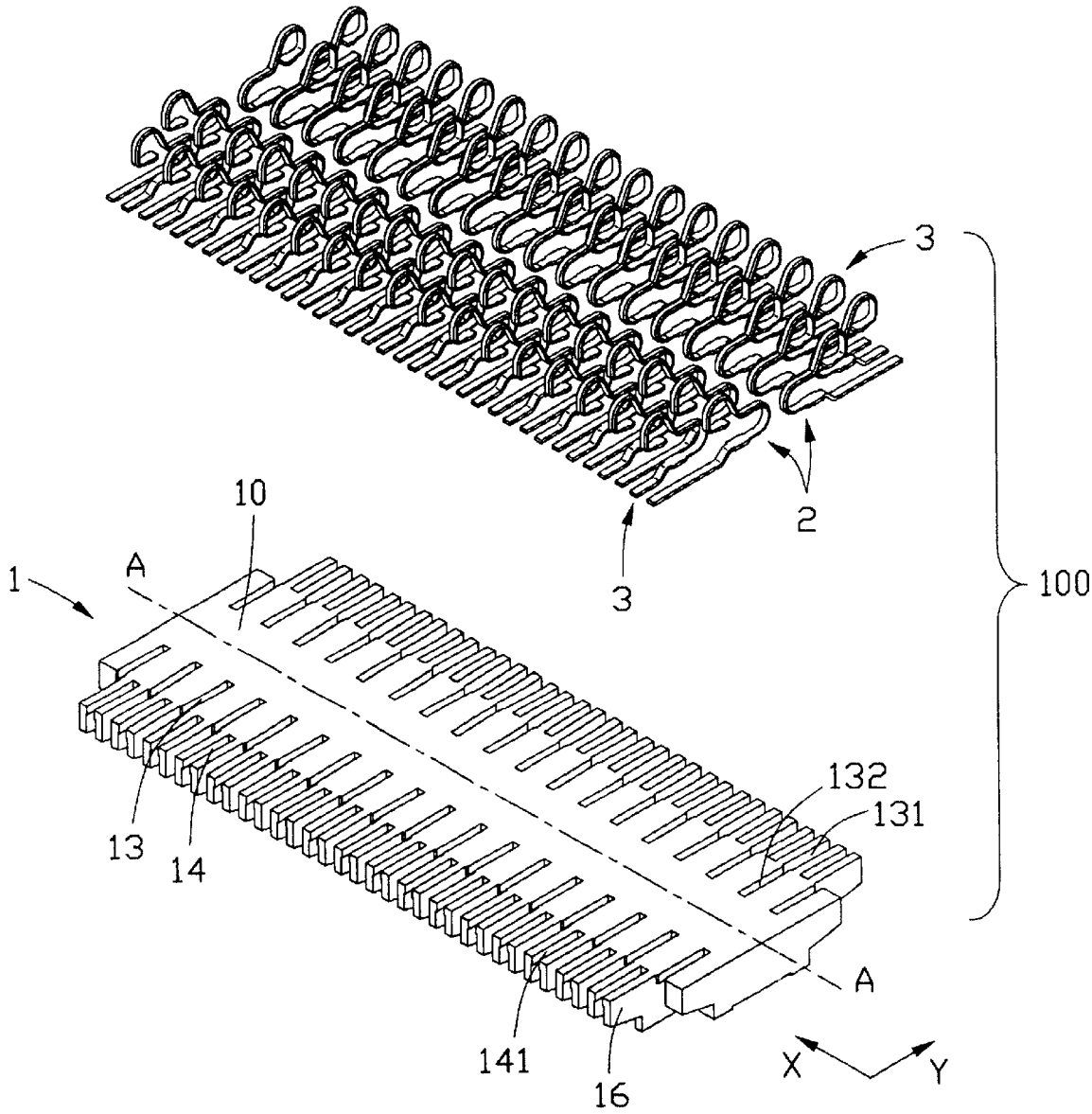
FIG. 1 is an exploded view of an electrical connector according to the present invention.
Figure 2:
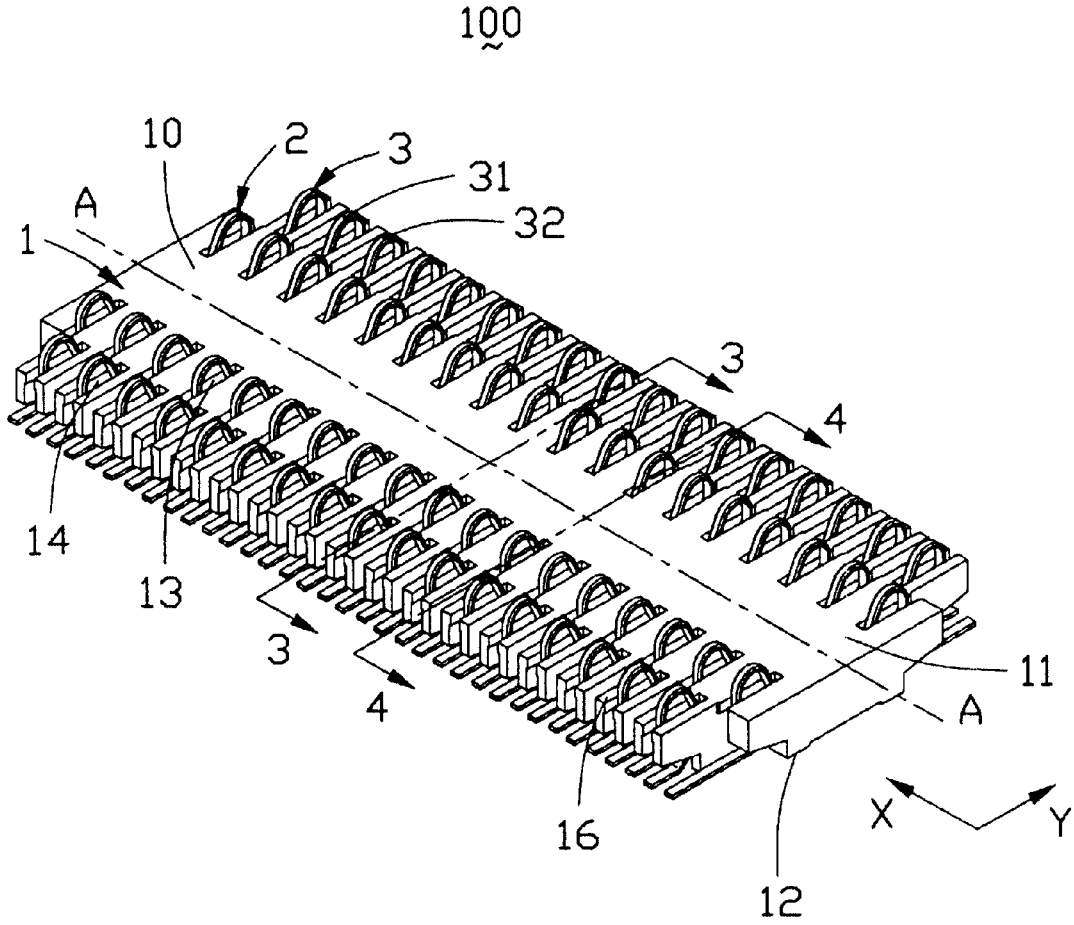
FIG. 2 is an assembled view of FIG. 1.

Referring to FIGS. 1 and 2, an electrical connector 100 of the present invention is provided for interconnecting a first and a second printed circuit boards (PCBs, not shown). The connector 100 includes an insulative base 1 and a first and a second sets of contacts 2, 3 received in the base 1.

The base 1 includes a body portion 10 and a plurality of partitions 16 extending from opposite sides of the body portion 10. A common upper surface 11 of the body portion 10 and the partitions 16 is provided for engaging with the first PCB, and a common lower surface 12 is provided for mounting on the second PCB.

The base 1 defines a plurality of pairs of first channels 13 and a plurality of pairs of second channels 14 through the upper and the lower surfaces 11, 12 for respectively receiving the first and second sets of contacts 2, 3. Each pair of the first or second channels 13, 14 are configured symmetrically to each other about a longitudinal central line A—A. The first and the second channels 13, 14 are alternatingly arranged.

Figure 3:
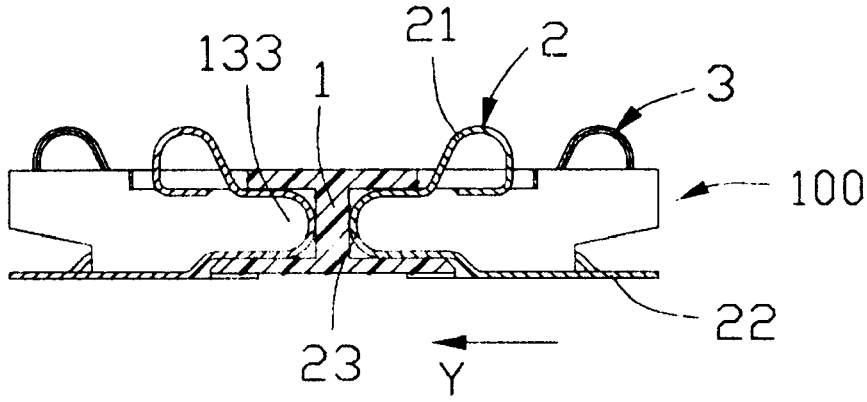
FIG. 3 is a cross-sectional view taken along a line 3—3 in FIG. 2.

Referring to FIGS. 1 and 3, each first channel 13 has an opening 131 defined by two neighboring partitions 16, a first exposing portion 132 defined in the body portion 10 and exposed to the upper and lower surfaces 11, 12, and a first mounting recess 133 defined in the body portion 10 in communicating with the first exposing portion 132.

Figure 4:
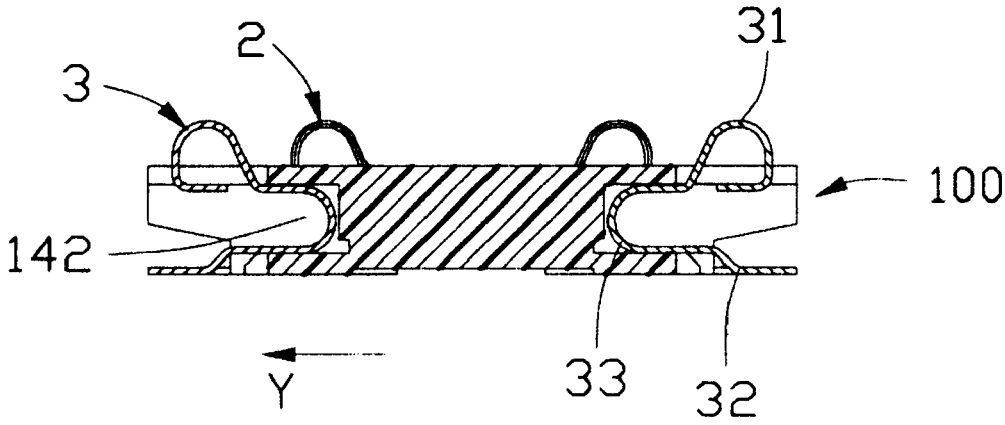
FIG. 4 is a cross-sectional view taken along a line 4—4 in FIG. 2.
Figure 5:
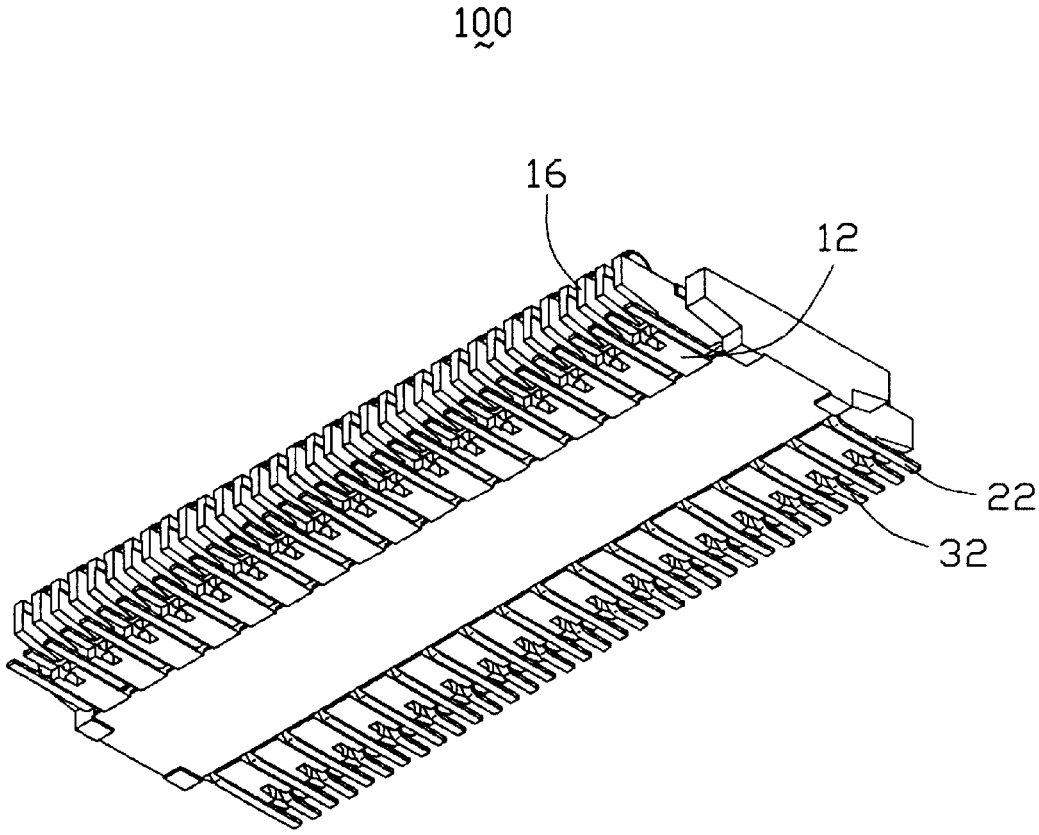
FIG. 5 is a perspective view of the electrical connector, taken from a bottom aspect.
Figure 6:
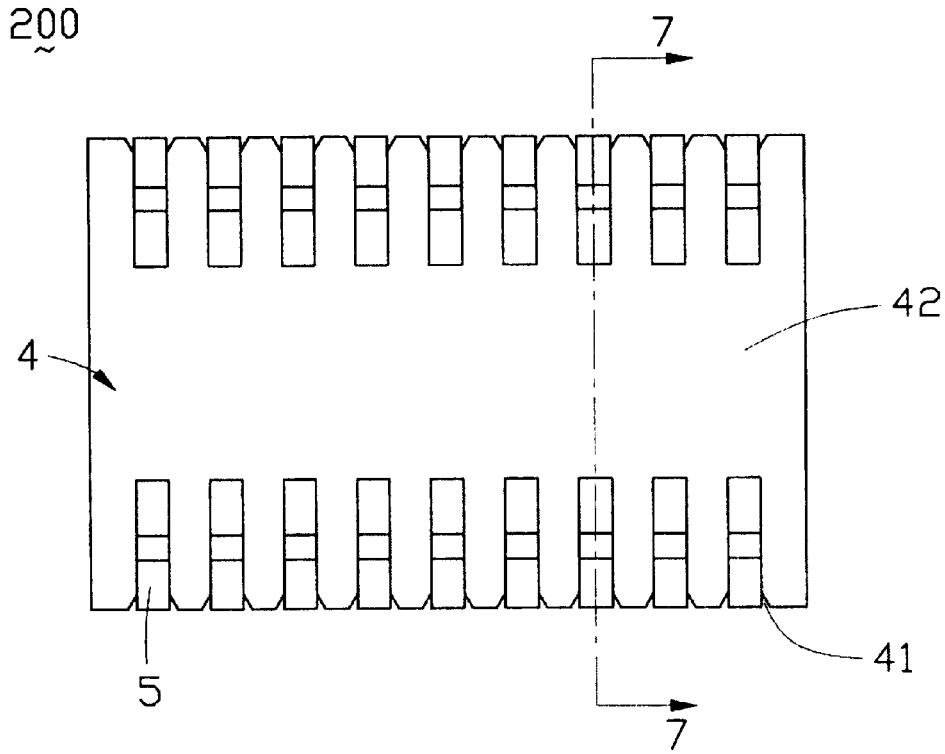
FIG. 6 (PRIOR ART)
FIG. 6 is a top view of a conventional electrical connector.
Figure 7:
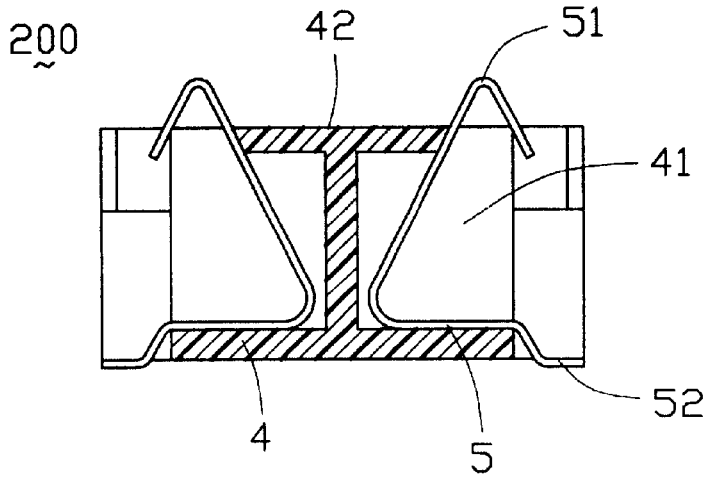
FIG. 7 (PRIOR ART)
FIG. 7 is a cross-sectional view taken along a line 7—7 in FIG. 6.

Referring to FIGS. 1 and 4, each second channel 14 includes an second exposing portion 141 defined by two neighboring partitions 16, and a second mounting recess 142 defined in the body portion 10 in communicating with the second exposing portion 141.

Referring to FIGS. 3 and 4, each of the first set of contacts 2 includes a first spring contact portion 21, a first solder tail 22, and a U-shaped first mounting portion 23 connecting the first contact portion 21 with the first solder tail 22. Each of the second set of contacts 3 includes a second contact portion 31, a second solder tail 32, and a U-shaped second mounting portion 33. The second contact portion 31 and the second mounting portion 33 are respectively configured substantially the same as the first contact portion 21 and the first mounting portion 23. The first solder tail 22 is longer than the second solder tail 32 by a length of the first exposing portion 132.

Referring to FIGS. 2, 3, 4 and 5, in assembly, the first and the second contacts 2, 3 are respectively inserted into the first and the second channels 13, 14 from opposite sides of the base 1. The first and second mounting portions 23, 33 of the first and the second contacts 2, 3 are respectively received in the first and the second mounting recesses 133, 142. The first and the second contact portions 21, 31 extend beyond the upper surface 11 of the base 1 from the first and the second exposing portion 132, 141, such that the first and the second contact portions 21, 31 are staggered in a Y direction to increase the strength of the base 1, thereby efficiently preventing warpage of the base 1. The first and the second solder tails 22, 32 extend in a common plane for mounting to the second PCB.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for interconnecting a first and a second printed circuit boards (PCBs) comprising:

an insulative base having an upper surface for engaging with the first PCB, a lower surface for mounting on the second PCB, and a plurality of first and second channels arranged in one side of the base and exposed to said upper surface, the first and second channels respectively having first and second exposing portions, arranged in two rows; and a first and a second sets of contacts respectively received in the first and second channels, the first and second sets of contacts respectively having first and second contact portions extending beyond said upper surface of the base through the first and second exposing portions: wherein each second channel is defined between ever two adjacent first channels; wherein the insulative base has a body portion and a pluraliy of partitions extending, from a side of the body portion; wherein each first channel has an opening defined between two neighboring partitions and a first mounting recess defined in the body portion, and wherein the first exposing portion is defined in the body portion in communication with the first mounting recess; wherein the second exposing portion of each second channel is defined between two neighboring partitions, and each second channel farther has a second mounting recess defined in the body portion of the base and in communication with the second exposing portion; wherein each of the first set of contacts has a first solder tail in a common plane with the lower surface of the base through the opening and the first exposing portion of a corresponding first channel for soldering on the second PCB, and a first U-shaped mounting portion connecting the first contact portion and the first soldering portion and received in the first mounting recess; wherein each of the second set of contacts has a second solder tail in a common plane the lower surface of the base through the second exposing portion of a corresponding second channel for soldering on the second PCB, and a second U-shape mounting portion connecting the second contact portion and the second soldering portion and received in the second mounting recess; wherein a distance between each first contact portion and a longitudinal center line of the base is different from that between each second contact portion and the longitudinal center line of the base.

* * * * *